US007078853B2

(12) United States Patent
Hwang et al.

(10) Patent No.: US 7,078,853 B2
(45) Date of Patent: Jul. 18, 2006

(54) DEFLECTION APPARATUS FOR CATHODE RAY TUBE

(75) Inventors: Sung-Gu Hwang, Suwon (KR); Yasunobu Kuwahara, Suwon (KR)

(73) Assignee: Samsung SDI Co., Ltd., Suwon (KR)

( * ) Notice: Subject to any disclaimer, the term of this patent is extended or adjusted under 35 U.S.C. 154(b) by 152 days.

(21) Appl. No.: 10/361,222

(22) Filed: Feb. 10, 2003

(65) Prior Publication Data

US 2003/0201707 A1 Oct. 30, 2003

(30) Foreign Application Priority Data

Apr. 24, 2002 (KR) ..... 2002-22528

(51) Int. Cl.
*H01J 29/70* (2006.01)
*H01F 5/00* (2006.01)

(52) U.S. Cl. ..... 313/440; 313/413; 335/210; 335/213

(58) Field of Classification Search ..... 313/421, 313/416, 413, 412, 451, 426, 433, 440, 439; 315/368.28; 335/213, 210
See application file for complete search history.

(56) References Cited

U.S. PATENT DOCUMENTS 3,226,588 A * 12/1965 Barkow et al. ..... 335/213
3,488,541 A * 1/1970 Barbin ..... 335/213
3,889,218 A * 6/1975 Ishikawa ..... 335/213
3,912,182 A * 10/1975 Ishikawa ..... 242/437.3
5,801,481 A * 9/1998 Yokota ..... 313/440

* cited by examiner

*Primary Examiner*—Karabi Guharay
(74) *Attorney, Agent, or Firm*—Christie, Parker and Hale, LLP

(57) ABSTRACT

A deflection apparatus for a cathode ray tube includes a horizontal deflection coil, a vertical deflection coil positioned external to the horizontal deflection coil, an insulating member interposed between the horizontal and the vertical deflection coils, and a core placed on the insulating member while being connected to the vertical deflection coil. The horizontal deflection coil, the vertical deflection coil, the insulating member and the core have at least one sectional structure proceeding perpendicular to the tube axis of the cathode ray tube. With any one of the horizontal and the vertical deflection coils, the sectional structure is formed with a combination of arcs corresponding to a horizontal axis X, a vertical axis Y and a diagonal axis between the horizontal and the vertical axes X and Y. The arc corresponding to the horizontal axis X or the vertical axis Y is formed with an arc centering around a point on the axis other than the horizontal axis X or the vertical axis Y.

13 Claims, 7 Drawing Sheets

DEFLECTION APPARATUS FOR CATHODE RAY TUBE

CROSS-REFERENCE TO RELATED APPLICATIONS

This application claims priority to and the benefit of Korean Application No. 2002-22528, filed on Apr. 22, 2002 in the Korean Intellectual Property Office, the entire disclosure of which is incorporated herein by reference.

FIELD OF THE INVENTION

The present invention relates to a deflection apparatus for a cathode ray tube which is used as a television or computer monitor.

BACKGROUND OF THE INVENTION

Generally, a cathode ray tube is an electron tube where electron beams emitted from an electron gun are directed toward a screen while being deflected in the horizontal and the vertical directions, and land on phosphors of the screen, thereby displaying the desired picture images. The deflection of the electron beams is made by way of a deflection apparatus, which is externally mounted around a funnel to form horizontal and vertical magnetic fields.

A cathode ray tube is mainly used as a color television or computer monitor. Recently, it is spotlighted for use in producing a wide-screened flat panel display, or a high definition digital television (HDTV), depending upon the interests of the consumers.

In order for a cathode ray tube to make a high quality picture image, the deflection frequency of the deflection apparatus should be heightened. Furthermore, in order for a cathode ray tube to be shortened in the electric field, the wide-angled deflection should be made with respect to the electron beams. For this purpose, it has been proposed that the external surface of the funnel externally mounted with the deflection apparatus should be varied in shape from the neck side to the panel side. For instance, the external shape of the funnel may be gradually varied from a circle to a non-circle.

That is, in the above technique, the funnel bears a rectangular sectional shape so that the deflection apparatus can perform its deflection operation well while being placed closer to the scanning route of the electron beams. In this way, the wide-angled deflection for the electron beams can be realized without heightening the deflection power consumption.

Meanwhile, the deflection apparatus usually has deflection coils for forming horizontal and vertical deflection magnetic fields, an insulating member placed between the horizontal and the vertical deflection coils, and a core formed on the insulating member while being connected to the vertical deflection coil.

The deflection apparatus is mounted around the funnel portion of the cathode ray tube, called the "cone portion." FIG. 9 schematically illustrates the horizontal and the vertical deflection coils of the deflection apparatus mounted around the cone portion with a rectangular sectional shape. Reference numeral 2 indicates the cone portion.

The cone portion 2 has a rectangular section with a long axis X and a short axis Y. The deflection apparatus 4 externally mounted around the cone portion 2 has a pair of horizontal and vertical deflection coils 4*a* and 4*b*. The horizontal and vertical deflection coils 4*a* and 4*b* have a rectangular section corresponding to the section of the cone portion 2.

Meanwhile, as the deflection coils 4*a* and 4*b* of the deflection apparatus 4 have a rectangular section, the section thereof is outlined with a combination of an arc centering around a point on the long axis X, an arc centering around a point on the short axis Y, and an arc centering around a point on the diagonal axis between the long and the short axes X and Y.

Specifically, as shown in FIG. 10, the horizontal deflection coil 4*a* is formed with a combination of arcs R1 and R2 centering around points x1 and x2 on the long axis X, arcs R3 and R4 centering around points y1 and y2 on the short axis Y, and arcs R5 and R6 centering around points (not shown) on the diagonal axis. The vertical deflection coil 4*b* is formed with a combination of arcs R7 and R8 centering around points x2 and x3 on the long axis X, arcs R9 and R10 centering around points y2 and y3 on the short axis Y, and arcs R11 and R12 centering around points (not shown) on the diagonal axis.

That is, the deflection coils 4*a* and 4*b* of the deflection apparatus have a section outlined with a combination of the arcs centering around the points on the same axes.

However, in the above-structured deflection apparatus, the distribution of the deflection magnetic fields formed by way of the deflection coils is limited so that it is difficult to form the desired distribution of the magnetic fields depending upon the characteristics of the cathode ray tube.

As shown in FIG. 11, in case the distribution of the deflection coils is determined on the basis of a point Xa on the X axis, the thickness thereof close to the X axis is determined to be T1, and the thickness thereof close to the diagonal axis to be T2. If the reference point Xa is shifted to alter the coil distribution close to the diagonal axis, T1 and T2 are altered at the same time while being deviated from the expected value. If the coil distribution is altered on the basis of another point Xc on the X axis, only the thickness of the coil close to the diagonal axis is altered, and this limits alteration in the coil distribution.

In order to alter the coil distribution from the region close to the X axis to the region close to the diagonal axis in a desired manner, a gradual design alteration should be introduced, but this involves a difficulty in the working condition.

Therefore, with the conventional deflection apparatus, the desired coil distribution is not made in a fluent manner, and the degree of freedom in the formation of deflection magnetic fields is lowered so that the deflection apparatus does not function well in an appropriate manner.

SUMMARY OF THE INVENTION

In one embodiment, the present invention provides a deflection apparatus for a cathode ray tube which enhances the degree of freedom in the formation of the magnetic fields while improving the deflection of the electron beams.

According to one embodiment of the present invention, a deflection apparatus includes a horizontal deflection coil, a vertical deflection coil positioned external to the horizontal deflection coil, an insulating member interposed between the horizontal and the vertical deflection coils, and a core placed on the insulating member connected to the vertical deflection coil. The horizontal deflection coil, the vertical deflection coil, the insulating member and the core have at least one sectional structure proceeding perpendicular to a tube axis of the cathode ray tube. With any one of the horizontal and the vertical deflection coils, the sectional structure is formed with a combination of arcs corresponding to the horizontal axis X, the vertical axis Y, and the diagonal axis between the horizontal and the vertical axes X and Y. The arc corresponding to the horizontal axis X or the vertical axis Y is formed with an arc centering around a point on an axis different from the horizontal axis X or the vertical axis Y.

The arcs corresponding to the horizontal axis X and the vertical axis Y are formed with arcs centering around a point on an axis other than the horizontal and the vertical axes. The portion of the deflection coil formed with the arcs corresponds to the outer surface of the deflection coil.

DETAILED DESCRIPTION OF THE INVENTION

Figure 1:
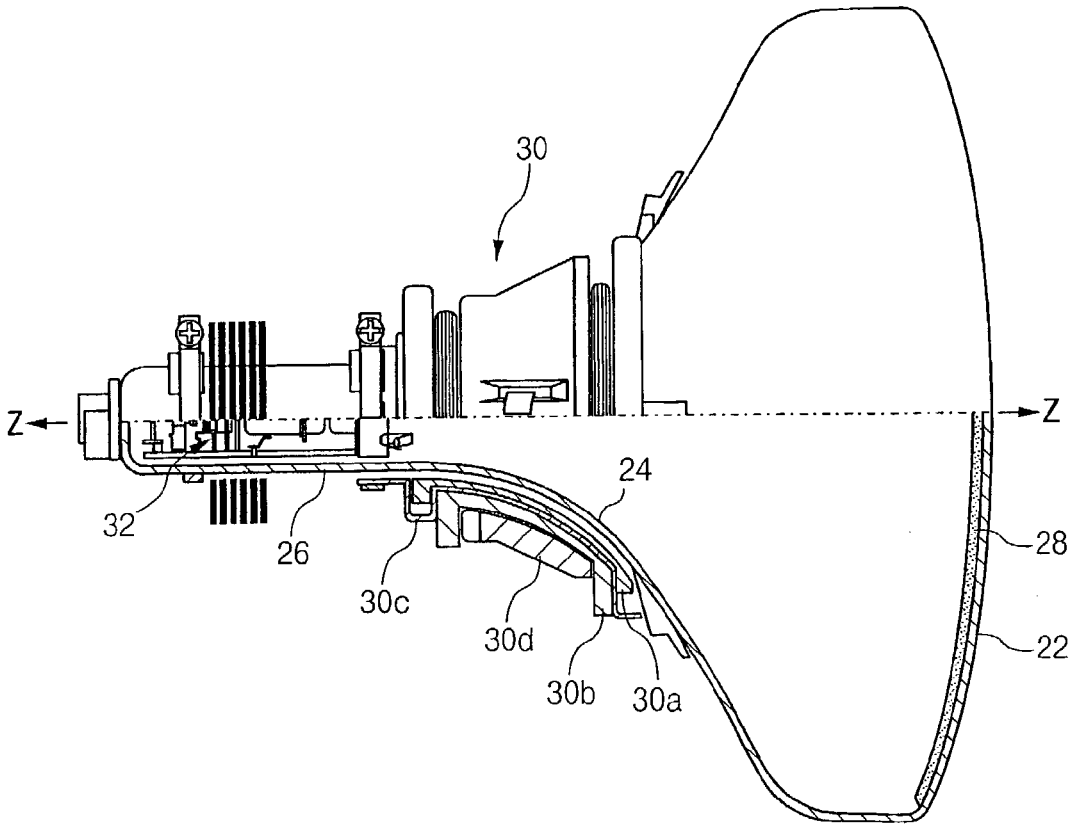
FIG. 1 is a side half elevation view of a cathode ray tube with a deflection apparatus according to an embodiment of the present invention.

FIG. 1 is a side half elevation view of a cathode ray tube according to one embodiment of the present invention. As shown in FIG. 1, the cathode ray tube includes a panel 22 bearing a rectangular shape, a funnel 24 connected to the panel 22 with a cone shape, and a neck 26 connected to the funnel 24 while being formed with a cylindrical tube. The panel 22, the funnel 24 and the neck 26 are assembled into a tube, the inside of which is kept to be in a vacuum state.

A phosphor screen 28 is formed at the inner surface of the panel 24 with a predetermined pattern of R, G and B phosphors. A deflection apparatus 30 is mounted around the outer surface of the funnel 24 to deflect electron beams, which are scanned toward the phosphor screen 28. An electron gun 32 is mounted within the neck 26 to produce the electron beams. With the electron gun 32, three R, G and B cathodes are arranged in line to emit the R, G and B electron beams.

The electron beams emitted from the electron gun 32 are scanned toward the center of the phosphor screen 28 or the periphery thereof, hitting the correct phosphors on the phosphor screen 28 to make the desired picture image. When the electron beams are scanned toward the periphery of the phosphor screen 28, they are deflected under the influence of magnetic fields formed at the deflection apparatus 30.

In the operation of the cathode ray tube, the deflection apparatus 30 makes formation of horizontal and vertical magnetic fields, and the electron beams are deflected toward the periphery of the screen under the influence of the magnetic fields when they pass through the inside of the funnel 24. Particularly, in order to enhance the degree of freedom in forming the magnetic fields, the deflection apparatus 30 is structured in the following way.

The deflection apparatus 30 has a horizontal deflection coil 30*a*, a vertical deflection coil 30*b*, and an insulating member 30*c* interposed between the horizontal and the vertical deflection coils 30*a* and 30*b* to electrically insulate them from each other. The insulating member 30*c* is formed with a trumpet shape. The horizontal deflection coil 30*a* is placed at the inner surface of the insulating member 30*c*, and the vertical deflection coil 30*b* is placed at the outer surface of the insulating member 30*c*.

The horizontal and the vertical deflection coils 30*a* and 30*b* have a shape corresponding to the shape of the insulating member 30*c*, and hence, to the shape of the funnel 24. They are formed with a pair of coils while making the entire shape be a semi-trumpet shape.

Furthermore, a core 30*d* is placed external to the insulating member 30*c* while being connected to the vertical deflection coil 30*b*. In this embodiment, the core 30*d* and the vertical deflection coil 30*b* are standing in the inter-relationship such that the deflection apparatus 30 bears a saddle—saddle type.

Moreover, with the deflection apparatus 30, the horizontal deflection coil 30*a*, the vertical deflection coil 30*b*, the insulating member 30*c* and the core 30*d* are structured such that at least one section thereof perpendicular to the tube axis Z of the cathode ray tube is formed with a non-circular shape such as a rectangle.

Figure 2:
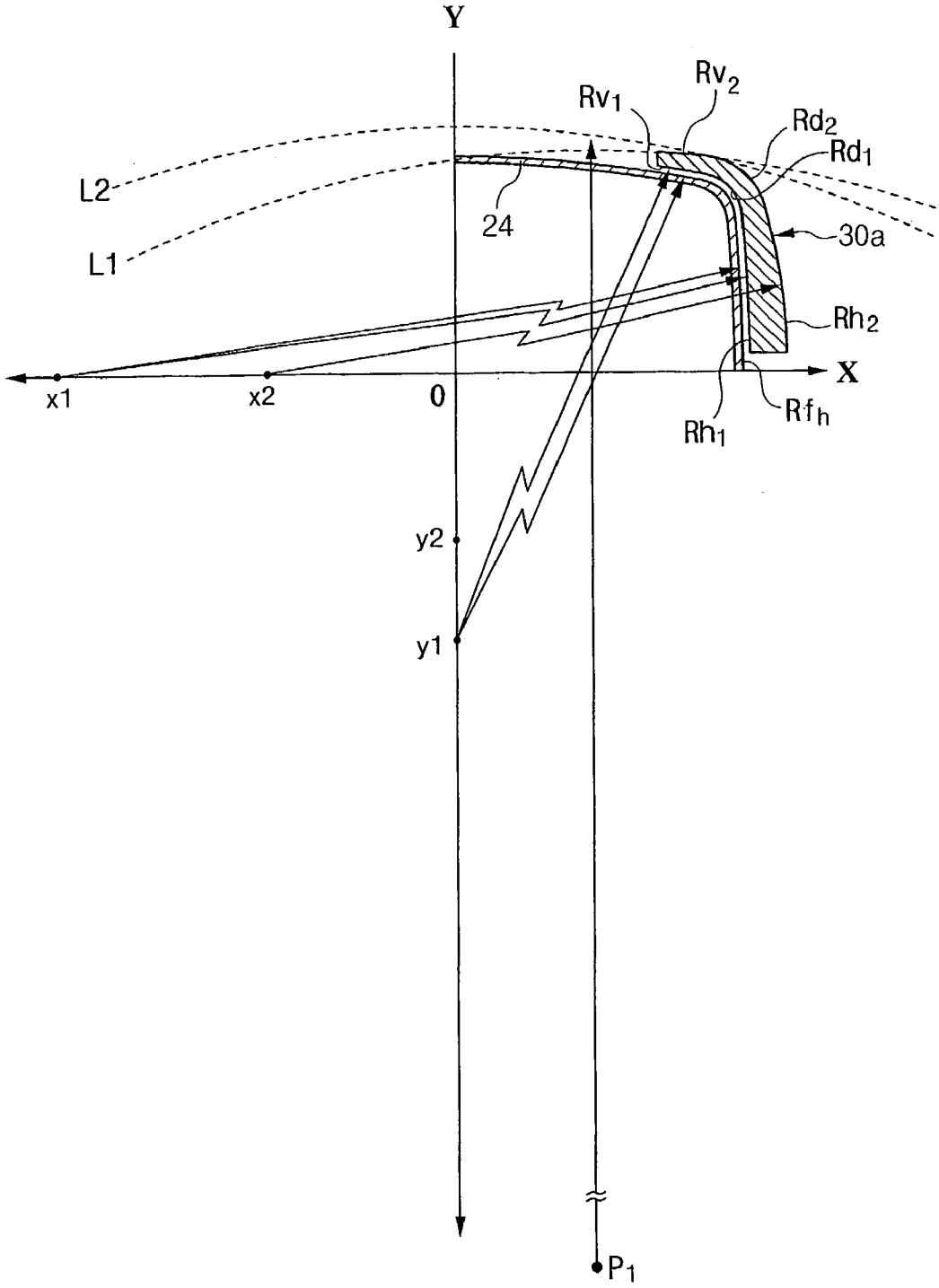
FIGS. 2 to 4 schematically illustrate the deflection apparatus shown in FIG. 1.

FIG. 2 schematically illustrates the deflection apparatus shown in FIG. 1, where the horizontal deflection coil 30*a* is fitted to the funnel 24. As shown in FIG. 2, the horizontal deflection coil 30*a* is positioned closer to the outer surface of the funnel 24 than the vertical deflection coil 30*b* when the deflection apparatus 30 is mounted around the outer surface of the funnel 24. The section of the horizontal deflection coil 30*a* is formed with a combination of arcs Rh1 and Rh2 corresponding to the horizontal axis X of the cathode ray tube, arcs Rv1 and Rv2 corresponding to the vertical axis Y, and arcs Rd1 and Rd2 corresponding to the diagonal axis (not shown) between the horizontal and the vertical axes X and Y while interconnecting the arcs.

Particularly, with the horizontal deflection coil 30*a*, the horizontal inner-axial arc Rh1 and the horizontal outer-axial arc Rh2 are established to be centered around arbitrary points x1 and x2 on the horizontal axis X. The horizontal inner-axial arc Rh1 and the arc R for the outer surface of the funnel 24 are centered around the same point.

By contrast, with the horizontal deflection coil 30*a*, the vertical inner-axial arc Rv1 is established to be centered around an arbitrary point y1 on the vertical axis Y. The vertical outer-axial arc Rv2 is established to be centered around an arbitrary point p1 distant from the vertical axis Y in the direction of the horizontal axis X. In this embodiment, the central point p1 is placed at the first quarter side.

In FIG. 2, the dotted line L1 indicates the whole line of the vertical outer-axial arc Rv2 of the horizontal deflection coil 30*a* according to the present invention, and the dotted line L2 indicates the whole line of the vertical outer-axial arc according to a prior art.

Meanwhile, the arcs Rd1 and Rd2 corresponding to the diagonal axis are formed with the arcs interconnecting the horizontal axial arcs Rh1 and Rh2 and the vertical axial arcs Rv1 and Rv2.

Figure 3:
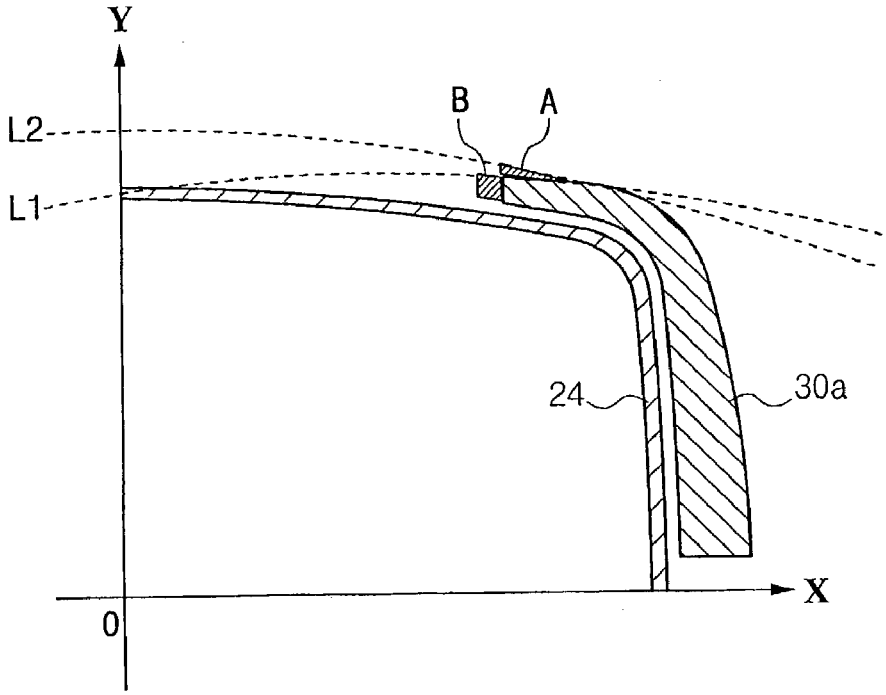

When the horizontal deflection coil 30*a* is structured in the above way, the area thereof is reduced by the A portion corresponding to the vertical axis Y, and the area B corresponding to the A portion is enlarged in the direction of the vertical axis Y as shown in FIG. 3.

Figure 4:
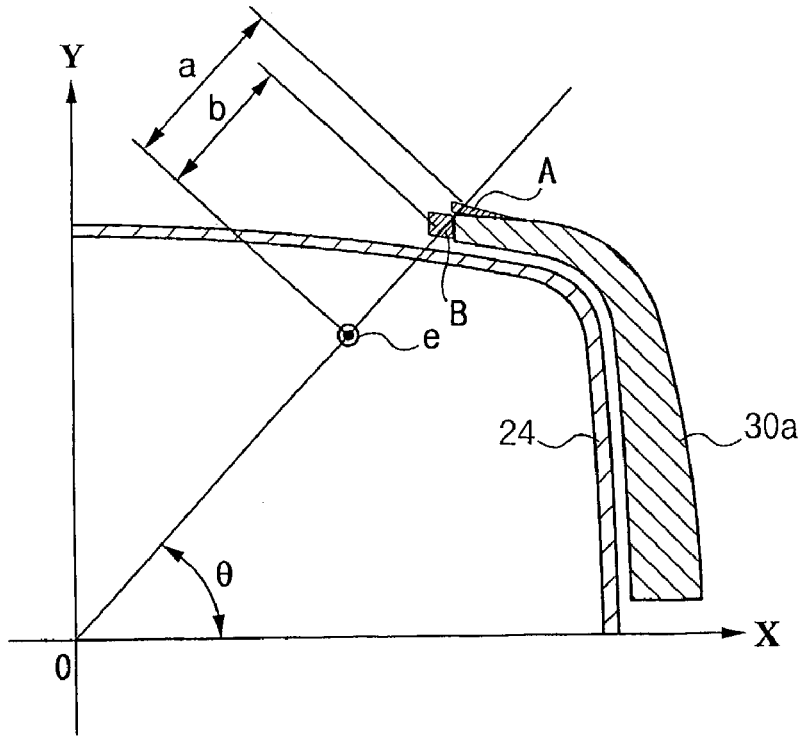

In accordance with variation in the shape of the horizontal deflection coil 30*a*, the deflection apparatus 30 can exert the following effects. That is, as shown in FIG. 4, in the operation of the cathode ray tube, assume that the electron beam e emitted from the electron gun passes through the funnel 24 mounted with the deflection apparatus 30, as shown in FIG. 4. In case the electron beam is positioned on the line angled by θ1 (for example, 50°) with respect to the horizontal axis X, the distance between the electron beam e and the portion of the horizontal deflection coil 30*a* close thereto is established to be b. This is compared to the prior art where the distance is established to be a. That is, this distance is reduced compared to the prior art. When the distance between the electron beam e and the horizontal deflection coil is reduced, the electron beam e can be well affected by the magnetic fields formed by the horizontal deflection coil 30*a*. This means that the power consumption by way of the deflection apparatus 30 can be reduced while making the deflection of the electron beam e in a desired manner.

In this embodiment, the distance is reduced by 20%, and the deflection sensitivity is enhanced by 40%.

Figure 5:
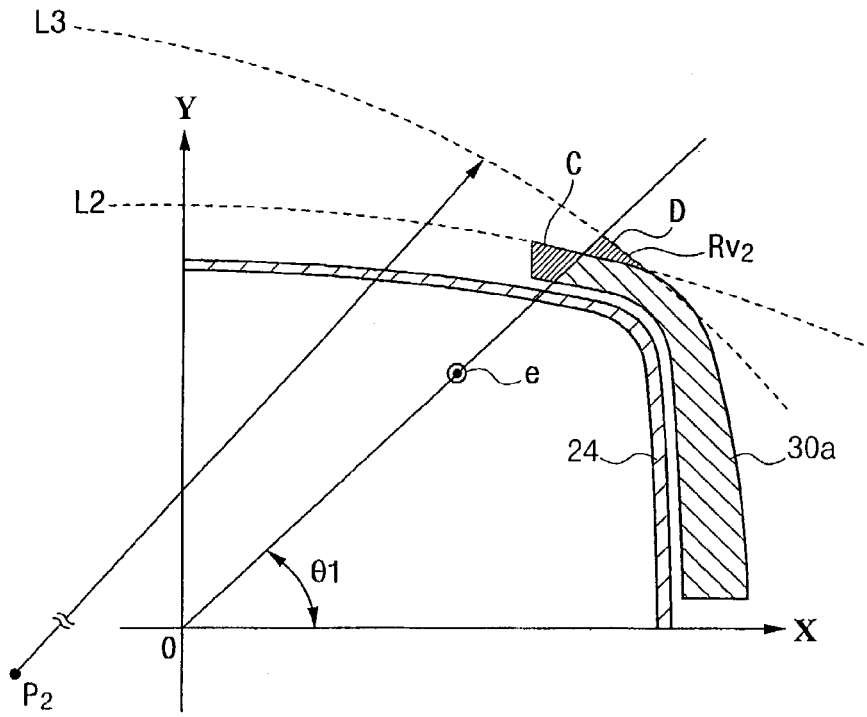
FIG. 5 illustrates a variation in the structure of the deflection apparatus shown in FIG. 1.

FIG. 5 illustrates a variation in the structure of the deflection apparatus 30. The vertical outer-axial arc Rv2 of the horizontal deflection coil 30*a* is formed with an arc centering around an arbitrary point P2 on the axis at the third quarter side, not on the vertical axis Y. Other arcs for the horizontal deflection coil 30*a* involve the same conditions as the above. In FIG. 5, the dotted line L3 indicates the whole line of the vertical outer-axial arc Rv2 of the horizontal deflection coil 30*a*.

With the variation, when the electron beam e is placed at the above-identified position with the operation of the cathode ray tube, the portion of the horizontal deflection coil 30*a* close to the line of the electron beam e is elongated by the D portion compared to the prior art-based case. Therefore, the horizontal deflection magnetic field deflects the electron beam e more strongly, and as a result, the electron beam e can reach the correct position on the phosphor screen in a desired manner. In FIG. 5, the portion indicated by C is the portion present at the prior art-based horizontal deflection coil, which is removed with the present invention.

Figure 6:
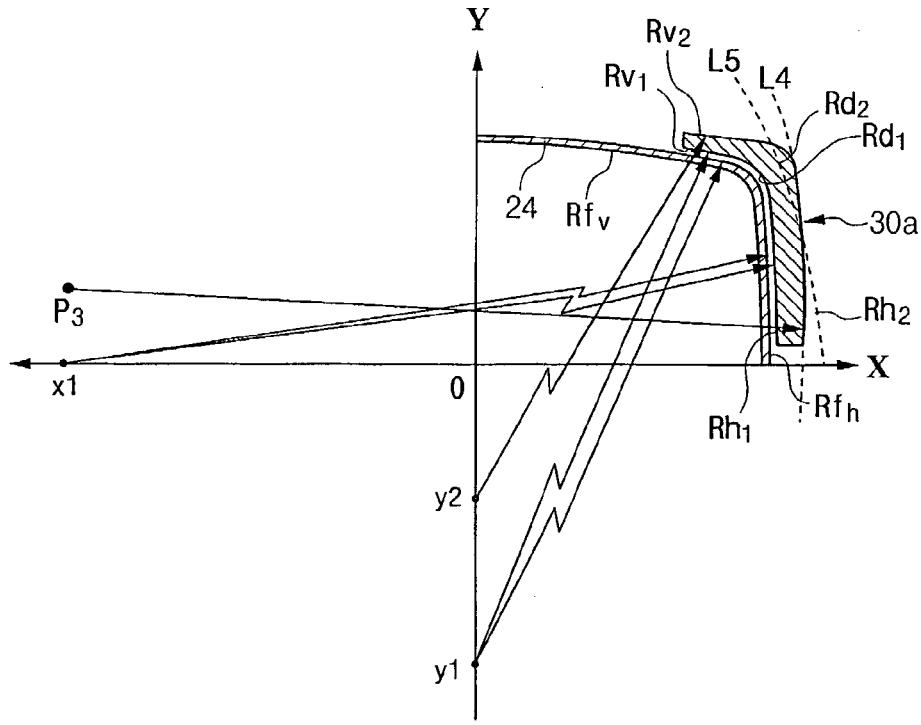
FIGS. 6 to 8 schematically illustrate a deflection apparatus for a cathode ray tube according to another embodiment of the present invention.

FIG. 6 is a schematic view of a deflection apparatus for a cathode ray tube according to another embodiment of the present invention. In this embodiment, the horizontal deflection coil 30*a* has a different-structured arc Rh2 corresponding to the horizontal axis X. Particularly, the horizontal deflection coil 30*a* is also formed such that at least one section thereof perpendicular to the tube axis Z of the cathode ray tube is formed with a non-circular shape such as a rectangle.

The vertical inner-axial arc Rv1 and the vertical outer-axial arc Rv2 corresponding to the vertical axis Y are centered around arbitrary points y1 and y2 on the vertical axis Y. The vertical inner-axial arc Rv1 and the arc Rfv for the outer surface of the funnel 24 are centered around the same point.

By contrast, the horizontal inner-axial arc Rh1 corresponding to the horizontal axis X is centered around an arbitrary point x1 on the horizontal axis X, and the horizontal outer-axial arc Rh2 is centered around an arbitrary point p3 distant from the horizontal axis X in the direction of the vertical axis Y. In this embodiment, the central point p3 is placed at the second quarter side.

In FIG. 6, the dotted line L4 indicates the whole line of the horizontal outer-axial arc Rh2 of the horizontal deflection coil 30*a* according to the present invention, and the dotted line L5 indicates the whole line of the horizontal outer-axial arc according to a prior art. Furthermore, the arcs Rd1 and Rd2 corresponding to the diagonal axis are formed with the arcs interconnecting the horizontal axial arcs Rh1 and Rh2 and the vertical axial arcs Rv1 and Rv2.

Figure 7:
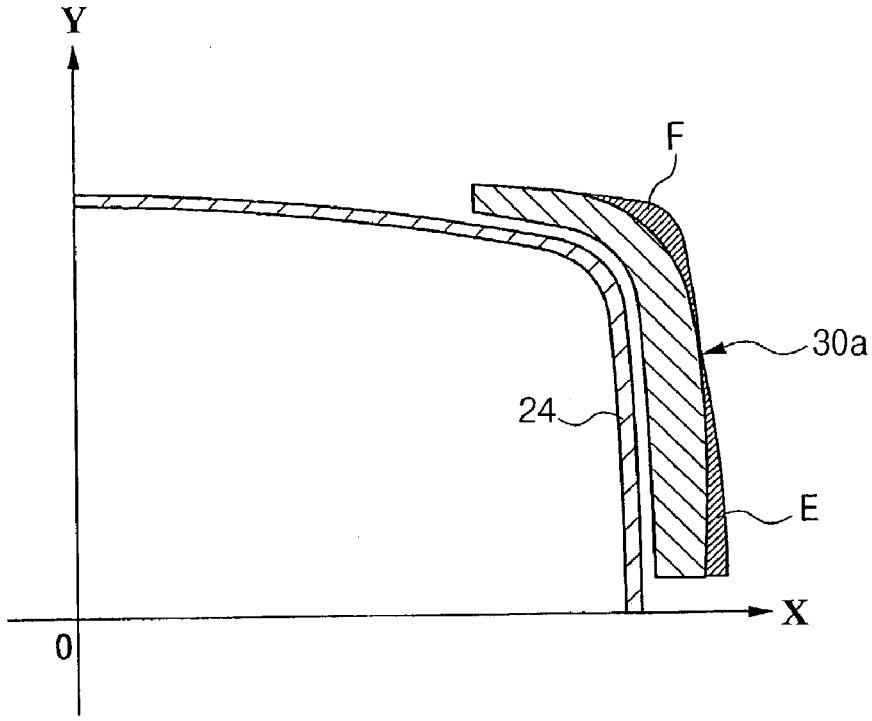

When the horizontal deflection coil 30*a* is structured in the above way, the area thereof is reduced by the E portion corresponding to the horizontal axis X, and the area F corresponding to the E portion is enlarged in the direction of the diagonal axis, as shown in FIG. 7.

Figure 8:
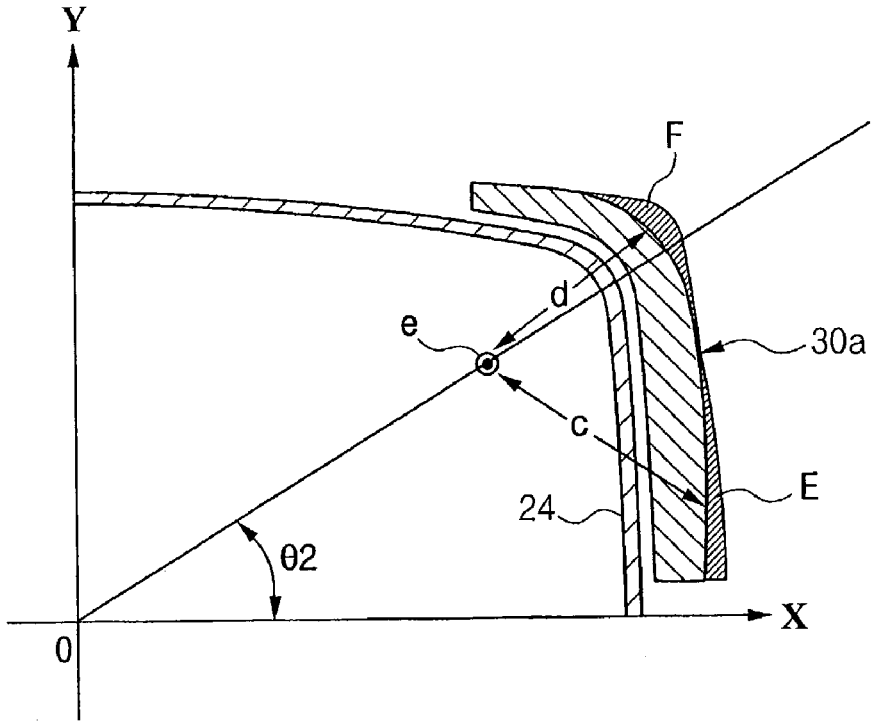
Figure 9:
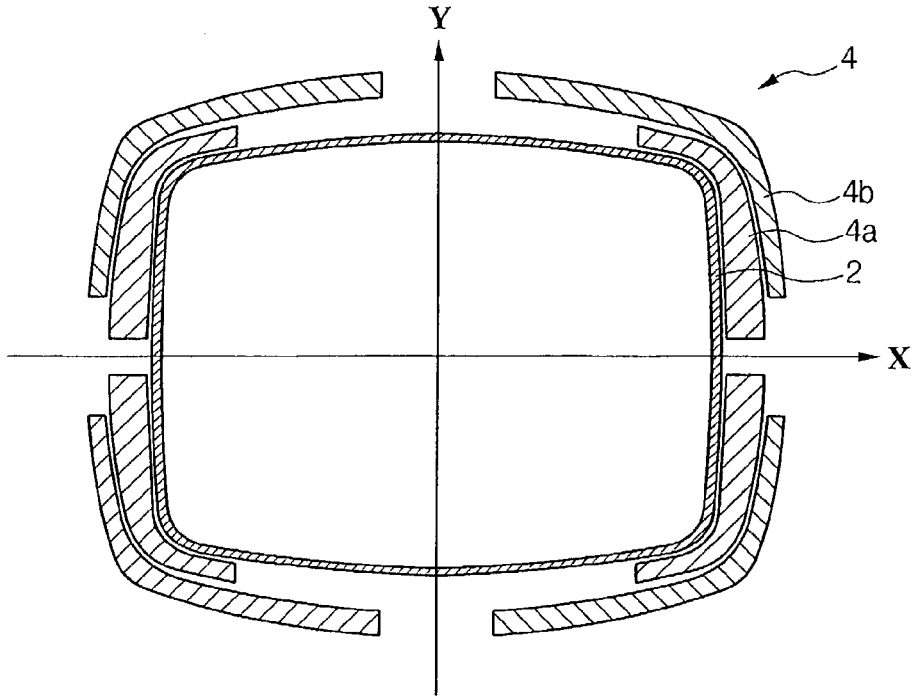
Fig. 9 (Prior Art)
FIGS. 9 to 11 schematically illustrate a deflection apparatus for a cathode ray tube according to a prior art.
Figure 10:
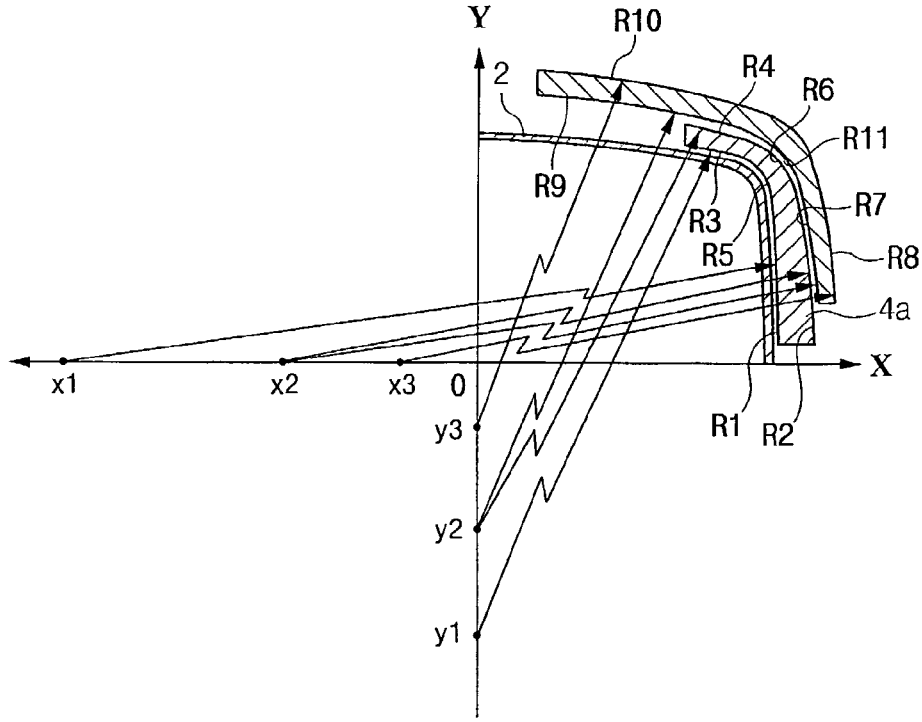
Fig. 10 (Prior Art)
Figure 11:
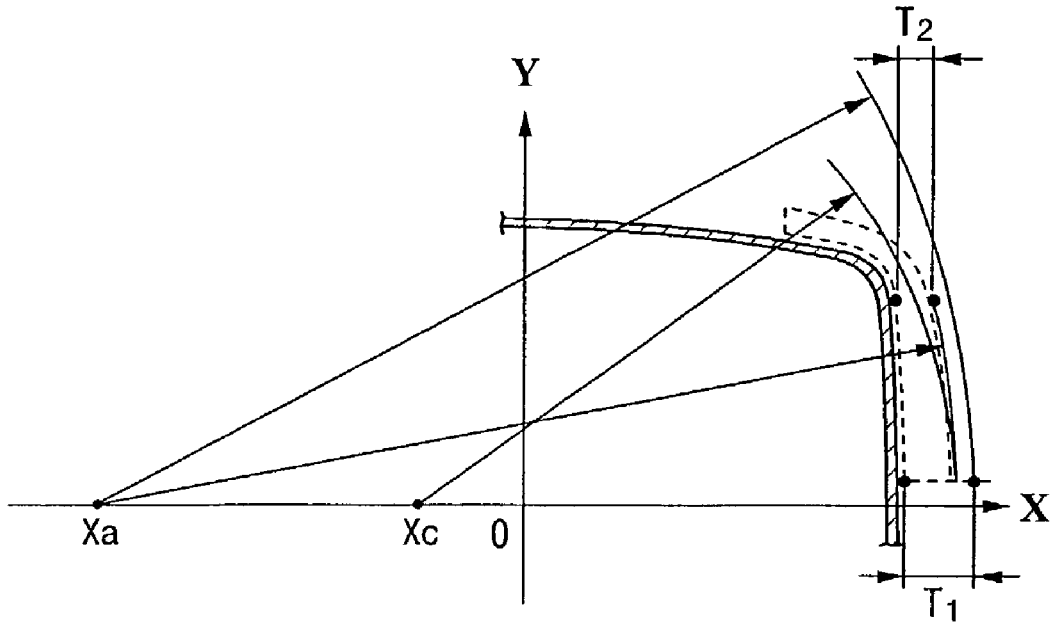
Fig. 11 (Prior Art)

In accordance with variation in the shape of the horizontal deflection coil 30*a*, the deflection apparatus 30 can exert the following effects. In the operation of the cathode ray tube, the electron beam e emitted from the electron gun passes through the funnel 24 mounted with the deflection apparatus 30. In case the electron beam is positioned on the line angled by θ2 (for example, 50°) with respect to the horizontal axis X, the electron beam e comes closer to the horizontal deflection coil 30*a* not in the direction of c but in the direction of d, as shown in FIG. 8. At this time, the electron beam e close to the horizontal deflection coil 30*a* is affected by the magnetic field more strongly by the F area while enhancing the deflection sensitivity thereof.

In designing the deflection coil for the deflection apparatus, the outer surface of the deflection coil is formed with an arc centering around a point on the axis different from the horizontal and the vertical axes. In this way, the desired deflection magnetic field is obtained depending upon the characteristics of the cathode ray tube while enhancing the degree of deflection sensitivity with respect to the electron beams.

The inventive structure may be applied for use not only in the horizontal deflection coil but also in the vertical deflection coil, or both in the horizontal and in the vertical deflection coils.

The section of the deflection coil is not limited to the combination of the arc corresponding to the horizontal axis, the arc corresponding to the vertical axis and the arc corresponding to the diagonal axis interconnecting those arcs, but may be formed with a combination of arcs corresponding to the horizontal and the vertical axes, and a rectilinear line interconnecting those arcs.

As described above, the deflection apparatus for the cathode ray tube has an effect where the deflection coil is not formed in a complicated way, but the degree of deflection sensitivity with respect to the electron beams is enhanced, thereby optimizing the display capacity of the resulting cathode ray tube.

While the present invention has been described in detail with reference to specific embodiments, those skilled in the art will appreciate that various modifications and substitutions can be made thereto without departing from the spirit and scope of the present invention as set forth in the appended claims.

What is claimed is:

1. A deflection apparatus for a cathode ray tube comprising:

a horizontal deflection coil;

a vertical deflection coil placed external to the horizontal deflection coil;

an insulating member interposed between the horizontal deflection coil and the vertical deflection coil; and a core placed on the insulating member connected to the vertical deflection coil, wherein the horizontal deflection coil, the vertical deflection coil, the insulating member, and the core have at least one sectional structure proceeding perpendicular to a tube axis of the cathode ray tube, and wherein with any one of the horizontal and the vertical deflection coils, the at least one sectional structure is formed with a first arc corresponding to a horizontal axis X, a second arc corresponding to a vertical axis Y and a third arc corresponding to a diagonal axis between the horizontal and the vertical axes X and Y, the horizontal axis X and the vertical axis Y forming four quarter sides, and at least one of the first arc and the second arc is formed with a center located inside a quarter side adjacent to a quarter side in which the sectional structure formed by the at least one of the first and second arc is located.

2. The deflection apparatus of claim 1 wherein a portion of the deflection apparatus formed with the first, second, and third arcs corresponds to an outer surface of the deflection apparatus.

3. The deflection apparatus of claim 1 wherein the horizontal deflection coil is placed at an inner surface of the insulating member and the vertical deflection coil is placed at an outer surface of the insulating member.

4. The deflection apparatus of claim 1 wherein insulating member has a trumpet shape.

5. A cathode ray tube comprising:

a panel bearing a rectangular shape;

a funnel connected to the panel and having an outer surface;

a neck connected to the funnel; and a deflection apparatus mounted around the outer surface of the funnel to deflect electron beams, wherein the deflection apparatus includes a horizontal deflection coil;

a vertical deflection coil placed external to the horizontal deflection coil;

an insulating member interposed between the horizontal deflection coil and the vertical deflection coil; and a core placed on the insulating member and connected to the vertical deflection coil, wherein the horizontal deflection coil, the vertical deflection coil, the insulating member and the core are in a sectional structure proceeding perpendicular to a tube axis of the cathode ray tube, and the sectional structure is formed with a first arc corresponding to a horizontal axis X, a second arc corresponding to a vertical axis Y and a third arc corresponding to a diagonal axis between the horizontal and the vertical axes X and Y, the horizontal axis X and the vertical axis Y forming four quarter sides, and at least one of the first arc and the second arc is formed with a center located inside a quarter side adjacent to a quarter side in which the sectional structure formed by the at least one of the first and second arc is located.

6. The cathode ray tube of claim 5 wherein a portion of the deflection apparatus formed with the first, second, and third arcs corresponds to an outer surface of the deflection apparatus.

7. The cathode ray tube of claim 5 wherein the horizontal deflection coil is placed at an inner surface of the insulating member and the vertical deflection coil is placed at an outer surface of the insulating member.

8. The cathode ray tube of claim 5 wherein the horizontal deflection coil is fitted to the funnel.

9. The cathode ray tube of claim 5 wherein the horizontal deflection coil is positioned closer to the outer surface of the funnel than the vertical deflection coil.

10. A deflection apparatus for a cathode ray tube comprising:

a horizontal deflection coil;

a vertical deflection coil placed external to the horizontal deflection coil;

an insulating member interposed between the horizontal deflection coil and the vertical deflection coil; and a core placed on the insulating member connected to the vertical deflection coil, wherein the horizontal deflection coil, the vertical deflection coil, the insulating member, and the core have at least one sectional structure having an inner surface, the sectional structure proceeding perpendicular to a tube axis of the cathode ray tube, the inner surface of the sectional structure being closer to the tube axis than an outer surface of the sectional structure, wherein with any one of the horizontal and the vertical deflection coils, the at least one sectional structure has a varying thickness in the plane defined by a horizontal axis X and a vertical axis Y, where the horizontal axis X, vertical axis Y, and tube axis all lie perpendicular to one another and form a three-dimensional space, wherein the thickness of the sectional structure along a first line perpendicular to a second line tangent to an arc defined by the inner surface of the sectional structure gradually increases away from a point of the sectional structure closest to at least one of the horizontal axis X and the vertical axis Y toward a point of the sectional structure corresponding to a diagonal axis between the horizontal axis X and the vertical axis Y, the increase in thickness being defined by an arc along the outer surface of the sectional structure, and wherein the thickness of the sectional structure gradually increases away from the points closest to both the horizontal axis X and the vertical axis Y toward a point of the sectional structure corresponding to a diagonal axis between the horizontal axis X and the vertical axis Y.

11. The deflection apparatus of claim 10 wherein a portion of the deflection apparatus formed by the sectional structure of increasing thickness corresponds to an outer surface of the deflection apparatus.

12. The deflection apparatus of claim 10 wherein the horizontal deflection coil is placed at an inner surface of the insulating member and the vertical deflection coil is placed at an outer surface of the insulating member.

13. The deflection apparatus of claim 10 wherein the insulating member has a trumpet shape.

* * * * *